US005653340A

United States Patent [19]

Daniel

[11] Patent Number: 5,653,340

[45] Date of Patent: Aug. 5, 1997

[54] WRAPAROUND PACKAGE WITH PERIPHERAL STRAP

[75] Inventor: Jean-Yves Daniel, Chateauroux, France

[73] Assignee: The Mead Corporation, Dayton, Ohio

[21] Appl. No.: 446,765

[22] PCT Filed: Sep. 23, 1994

[86] PCT No.: PCT/US94/10788

§ 371 Date: Jun. 2, 1995

§ 102(e) Date: Jun. 2, 1995

[87] PCT Pub. No.: WO95/08487

PCT Pub. Date: Mar. 30, 1995

[30] Foreign Application Priority Data

Sep. 23, 1993 [GB] United Kingdom ..... 9319652

[51] Int. Cl.[6] ..... B65D 71/06; B65D 71/46

[52] U.S. Cl. ..... 206/434; 206/194

[58] Field of Search ..... 206/194, 429, 206/434

[56] References Cited

U.S. PATENT DOCUMENTS

| | | | |
|---|---|---|---|
| 2,290,969 | 7/1942 | King | 206/434 |
| 2,300,874 | 11/1942 | Ferrari | 206/194 |
| 2,313,731 | 3/1943 | Brogden | 206/194 |
| 2,359,297 | 10/1944 | Brogden | 206/194 |
| 2,361,926 | 11/1944 | Brogden | 206/194 |
| 3,451,543 | 6/1969 | Graser et al. | 206/434 |
| 4,398,631 | 8/1983 | Graser | 206/427 |
| 4,796,754 | 1/1989 | Chaussadas et al. | 206/434 |
| 4,880,115 | 11/1989 | Chaussadas | 206/434 |

FOREIGN PATENT DOCUMENTS

| | | | |
|---|---|---|---|
| 711611 | 6/1965 | Canada . | |
| 0278723 | 8/1988 | European Pat. Off. . | |
| 0454450A1 | 10/1991 | European Pat. Off. . | |
| 1424536 | 12/1965 | France . | |
| 709309 | 5/1954 | United Kingdom | 206/429 |
| 1580966 | 12/1980 | United Kingdom . | |
| 2186550 | 8/1987 | United Kingdom . | |
| 2187161 | 9/1987 | United Kingdom . | |
| 2259907 | 3/1993 | United Kingdom . | |
| WO85/03274 | 8/1985 | WIPO . | |

*Primary Examiner*—Stephen P. Garbe
*Attorney, Agent, or Firm*—Tsugihiko Suzuki

[57] ABSTRACT

A package comprises a plurality of articles, a strap and a carton of a tubular structure. The articles are arranged in a group of at least one row such that the longitudinal axes of the articles are disposed vertically and parallel to each other. The strap extends generally horizontally around the circumference of the group of articles to hold the articles together in a unit. The carton includes a top wall panel, a pair of side wall panels and a pair of secured base panels. The carton extends around the group of articles such that the side wall panels are disposed over the straight runs of the strap, respectively. At least one of the side wall panels has a restraining flap for limiting vertical displacement of the strap. The flap is hinged to the side edge of the one side wall panel and is folded inwardly of the tubular structure into the space between adjacent articles in the row to be disposed at a location vertically adjoining the adjacent straight run.

5 Claims, 4 Drawing Sheets

WRAPAROUND PACKAGE WITH PERIPHERAL STRAP

The present invention relates to a package of the wraparound kind accommodating a plurality of articles, such as bottles, in which retention means for preventing dislodgement of the end-most bottles is required in addition to retention means provided by the carton itself.

Hence, a carton of the present invention comprises the combination of a wraparound carton and a strap, preferably a peripheral plastics strap secured around the midriff of the carton for maintaining the bottles in a closely clustered unit. One feature of a carton according to the invention is that it is shorter than the overall unit of bottles so that the end-most bottles are at least partially exposed to view. Due to its relatively short length the overall cost of this type of package is considerably lower than a full length carton which does not require a securing strap. In order to prevent vertical displacement of the securing strap, which, with a considerable variety of bottle shapes causes the strap to be slackened, the carton includes integral restraining means for cooperation with the strap to prevent the strap from being displaced out of position towards the tops or bottoms of the packaged articles.

GB1,580,966 discloses a wraparound bottle carrier which has a strap portion and a pair of inwardly folded flaps joined to the opposite end edges of each side wall of the carton. The inwardly folded flaps do not however cooperate with the strap in order to restrain movement thereof but are provided as integral parts of the retention structure of the paperboard wrapper provided to resist endways dislodgement of the heel portion of the endmost bottles in the package.

EP-454,450 discloses an article carrier of the top gripping type in which side panels thereof are held secured to the adjacent faces of the bottles by means of a circumferential strap. The strap is prevented from being displaced in a direction along the axis of the bottles by notches formed in the edges of the side panels.

None of these references suggests either alone or in combination, that an inwardly folded end flap of a carton may be engaged with a midriff carton strap to prevent displacement of the strap. Moreover none of the references suggest that a folded flap may engage a portion of a midriff strap extending between adjacent articles of the carton.

The present invention provides a wraparound carton accommodating a plurality of articles, such as bottles, in which the endmost articles in the carton are retained from dislodgement by a strap encircling said plurality of articles and wherein the carton includes integral restraining means which cooperate with said strap to limit any substantial displacement of the strap towards the top or base of the carton.

Figure 1:
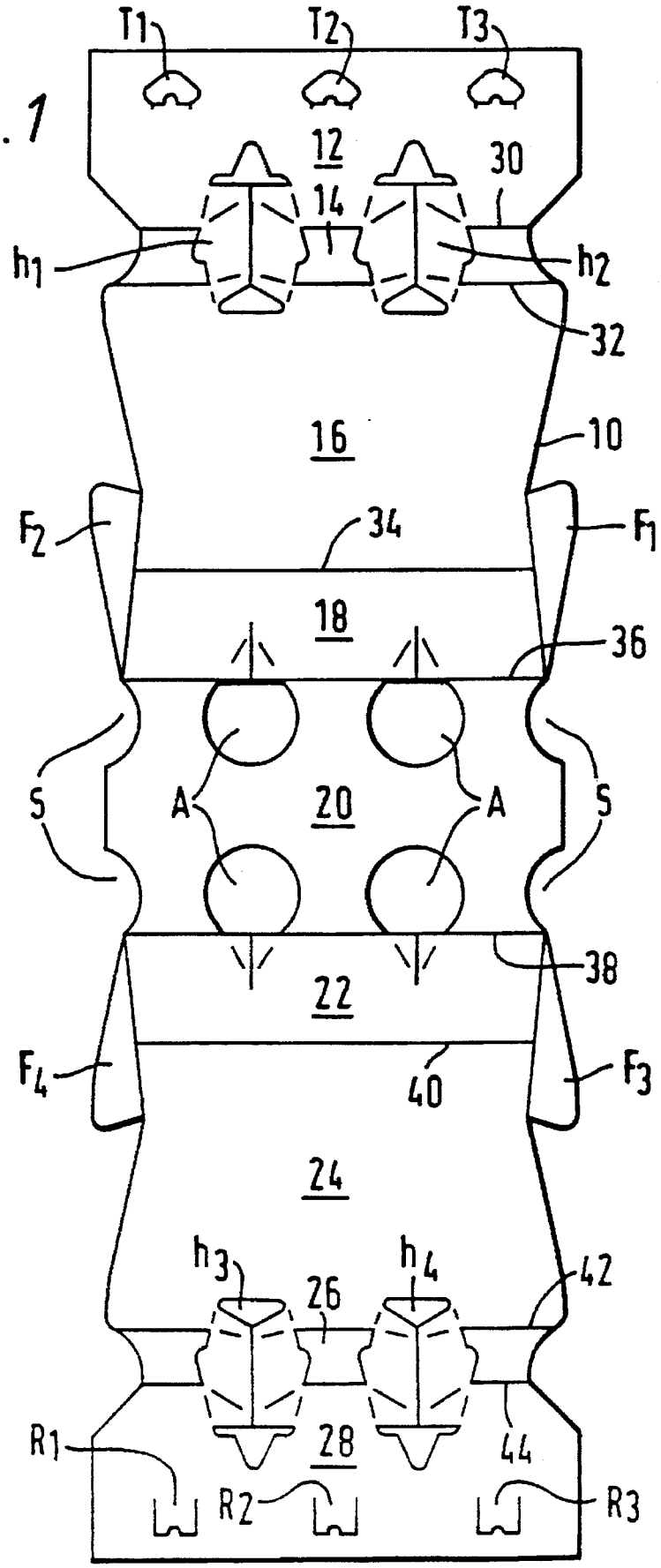
Figure 2A:
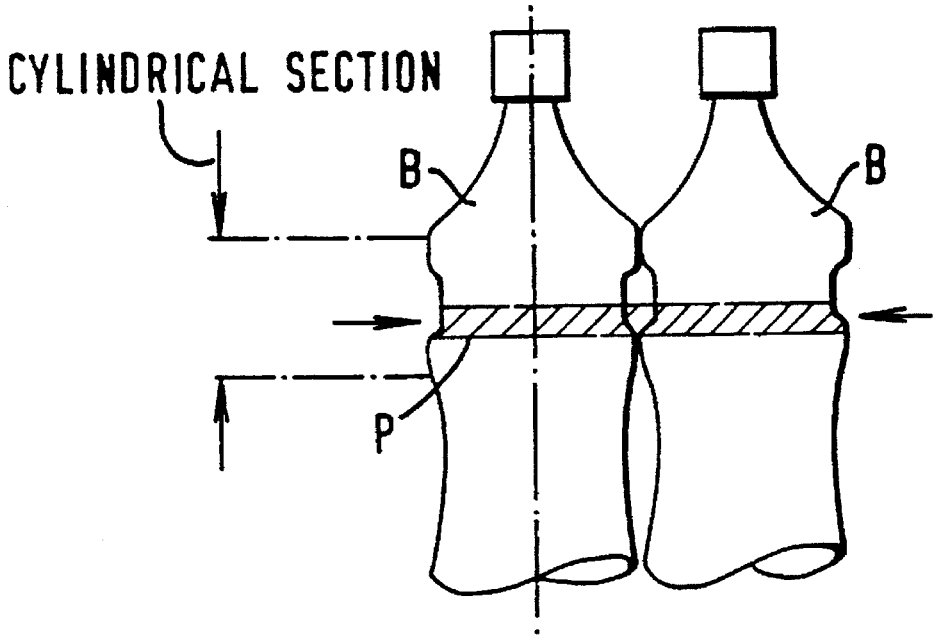
Figure 2B:
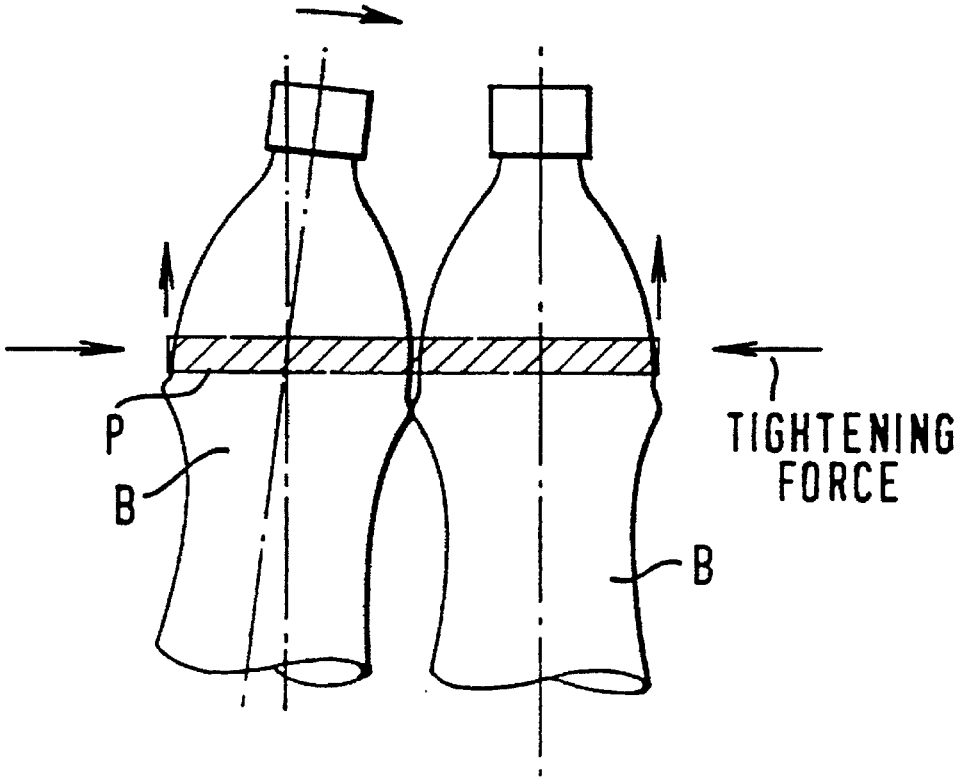
Figure 3:
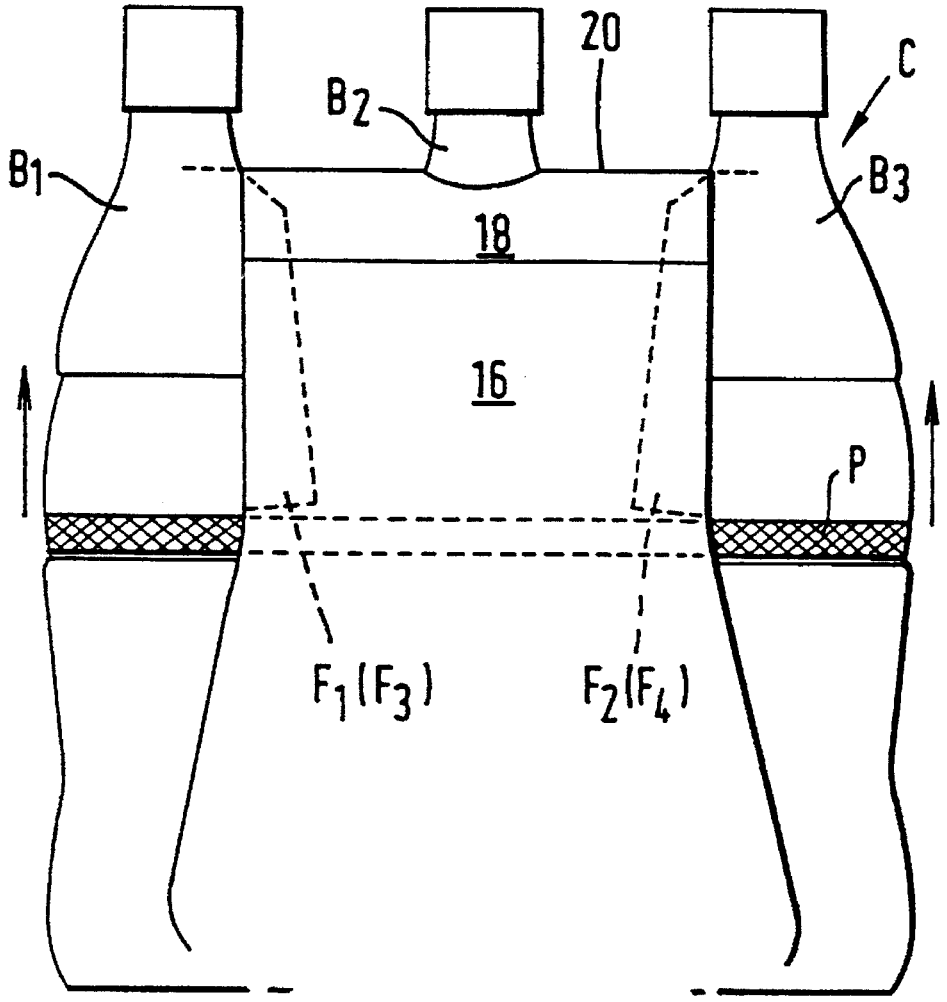
Figure 3A:
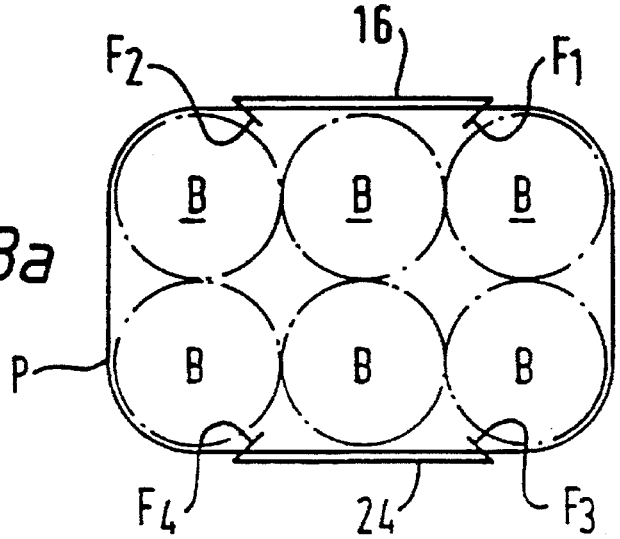

Embodiments of the invention will now be described, by way of example, with reference to the accompanying drawings, in which:

FIG. 1 is a plan view of a blank for accommodating a group of eight bottles in which upper strap retention flaps are provided;

FIGS. 2*a* and 2*b* are schematic end views of the end most bottles in cartons according to the invention;

FIG. 3 is a schematic side view of a carton and strap combination for a carton accommodating six bottles;

FIG. 3*a* is a schematic side view of the carton shown in FIG. 3; and

Figure 4:
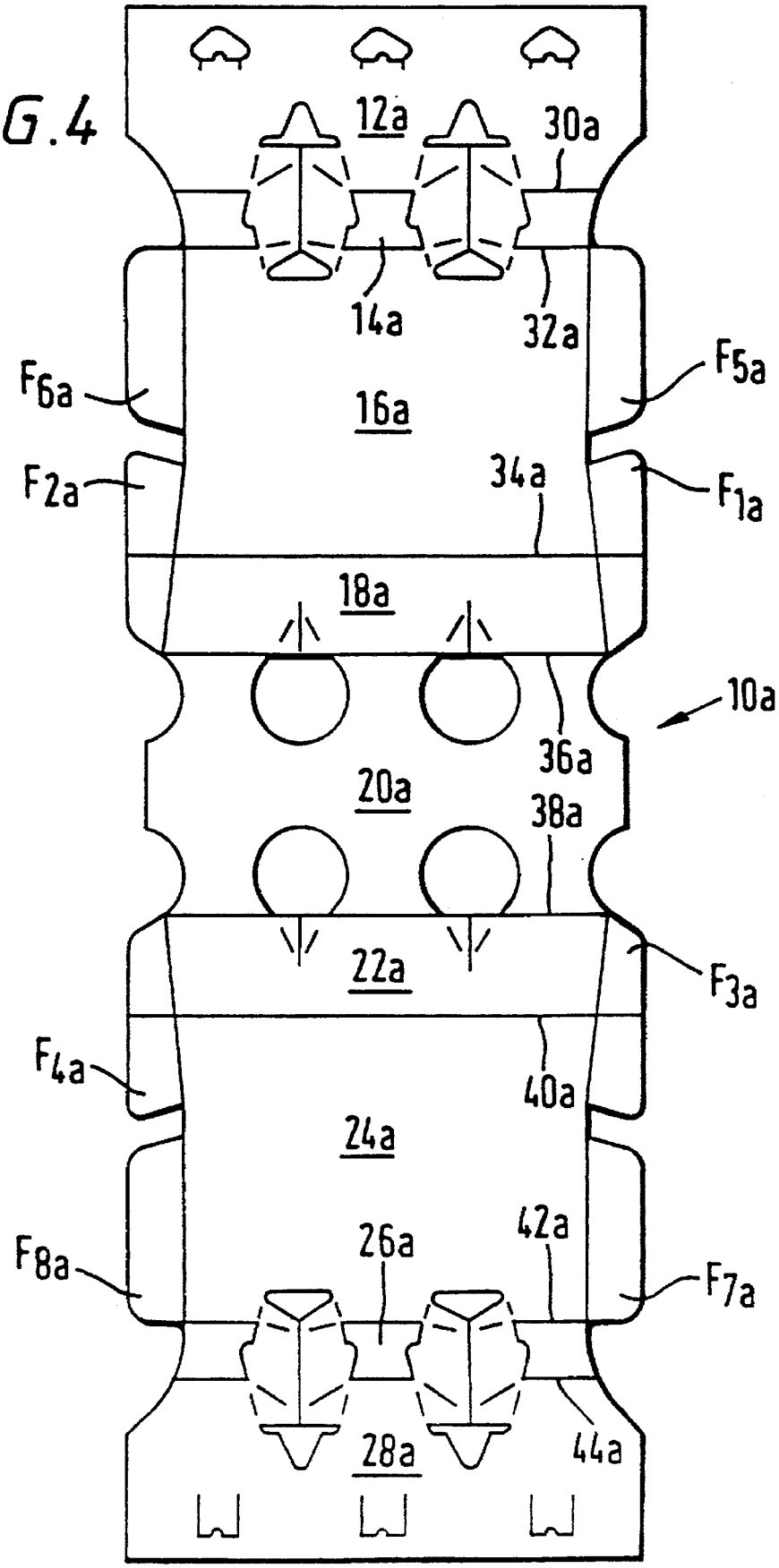

FIG. 4 is a plan view of another blank having both upper and lower strap retaining flaps.

Referring first to FIG. 1 of the drawings there is shown a carton blank 10 formed from paperboard or similar foldable sheet material and which comprises a first base panel 12 a first heel retention panel 14, a first main side wall panel 16, a first upper side wall panel 18, a top wall panel 20, a second upper side wall panel 22, a second main side wall panel 24, a second heel retention panel 26 and a second base panel 28 hinged one to the next along transverse fold lines 30–44 respectively.

The carton blank is adapted to wrap a group of eight bottles formed in two rows of four bottles each and to this end the carton is of the so called "neck through" wraparound variety and includes bottle neck receiving apertures A struck from the top panel 20 and scalloped regions "S" at opposite end edges of the top panel 20 to receive circumferential portions of the end most bottles of the group.

The bottle neck receiving apertures provide retention for the upper ends of the bottles but, of course, the scalloped areas "S" do not achieve any retention capability and further retention means are provided as described below.

In order to provide for the retention of the heels of the bottles, heel retention flaps h1, h2 are struck partially from base panel 12, heel panel 14 and main side panel 16 and likewise heel retention flaps h3, h4 are struck partially from the base panel 28, the heel panel 26 and main side panel 24. Further scalloped areas "Sh" are provided for heel portions of the endmost bottles. The blank is wrapped around the group of bottles to be accommodated and the base panels 12 and 28 are secured together in overlapping relationship by means of cooperating locking tabs T1, T2, T3 which cooperate with complementary locking apertures defined by retention tabs R1, R2 and R3 respectively.

In order to provide for retention of the endmost bottles in the group, the group of bottles is wrapped, substantially about its midriff, with a plastics strap. Thereafter the carton blank is applied to the strapped group. Preferably the plastics strap is formed from a heat shrinkable material and therefore is applied to the bottle group in relatively loose condition and thereafter tightened by shrinking through the application heat. Nevertheless, there is a tendency for the strap to shift vertically towards the top and/or bottoms of the bottles depending upon the shape of the bottles. For instance, FIG. 2*a* illustrates schematically an arrangement in which the strap "P" is applied to a group of bottles containing bottles of one form where shifting of the strap in either of the vertically upwards or downwards direction is a possibility. FIG. 3 shows a side view of the arrangement. FIG. 2*b* is a similar view to FIG. 2*a* but showing the strap applied to a form of bottle in which displacement of the strap vertically upwards, but not downwards, is likely. In particular, FIG. 2*b* shows the effect once the strap has shifted vertically upwards whereby the strap slackens and the bottles are free to tilt and therefore may become dislodged from the carton.

In order to prevent vertical dislodgement of the strap, the carton blank 10 is formed with a set of restraining flaps F1, F2, F3 & F4. Restraining flaps F1 and F2 are integral with and hinged to upper side wall panel 18 and main side wall panel 16 and, similarly, restraining flaps F3 and F4 are integral with and hinged to upper side wall panel 22 and main side wall panel 24.

Referring now to FIG. 3 and 3*a* of the drawings, it will be seen that once the blank has been wrapped about a group of bottles B (in this case the illustration shows a group of six bottles with three bottles in each row) the restraining flaps $F_1$, $F_2$ ($F_3$, $F_4$) are hinged inwardly so that they extend into the space between an adjacent pair of bottles and are disposed above the strap wrapped about the midriff of the bottle group within so that the lower edges of the restraining flaps are disposed immediately above a straight run of the strap which extends from one end-most bottle in the group to an opposite endmost bottle in the group and hence spans the space between those bottles.

FIG. 4 of the drawings shows a blank similar to that shown in FIG. 1 but in which two pairs of strap retention flaps are provided in association with each side wall of the carton. Accordingly in FIG. 4, like reference numerals to those of FIG. 1 designate like parts with the addition of suffix "a". The modified arrangement shown in FIG. 4 is for use with bottles of the form shown in FIG. 2*a* where the strap has a tendency to shift in either of the vertically upward or downward direction and therefore restraining flaps are required to restrict movement of the strap in either of the upward or downward direction. Hence restraining flaps $\mathbf{F1}_a$–$\mathbf{F4}_a$ are disposed inwardly of the carton immediately above the top edge of the strap to prevent upwards movement of the strap whereas restraining flaps $\mathbf{F5}_a$–$\mathbf{F8}_a$ are folded inwardly of the carton and are disposed immediately below the lower edge of the strap to prevent downward movement of the strap.

I claim:

1. A package comprising:

a plurality of articles each having a cylindrical section defining a longitudinal axis, said articles being arranged in a group of at least one row such that said axes of said articles are disposed vertically and parallel to each other;

a strap extending generally horizontally around a circumference of said group to hold said articles together in a unit, said strap including a pair of opposed parallel straight runs each extending from one endmost article in said row to an opposite endmost article in said row; and a carton of a tubular structure including a top wall panel, a pair of side-wall panels and a pair of secured base panels, said carton extending around said group such that said side wall panels are disposed over said straight runs and along opposite sides of said group, at least one of said side wall panels including restraining means for limiting vertical displacement of said strap, said restraining means comprising a flap hinged to a side edge of said at least one side wall panel, said flap being folded inwardly of said tubular structure into a space between adjacent articles in said row to be disposed at a location vertically adjoining an adjacent one of said straight runs.

2. The package according to claim 1 wherein said side edge of said at least one side wall panel extends transversely of said adjacent straight run.

3. The package according to claim 1 wherein said flap is disposed immediately above said adjacent straight run.

4. The package according to claim 1 wherein said flap is disposed immediately below said adjacent straight run.

5. The package according to claim 1 wherein said restraining means comprises a pair of upper and lower flaps hinged to said side edge of said at least one side wall panel, said upper and lower flaps being folded inwardly of said tubular structure to be disposed immediately above and below said adjacent straight run, respectively.

* * * * *